United States Patent [19]

Kato

[11] 4,317,434

[45] Mar. 2, 1982

[54] PREHEATING APPARATUS FOR DIESEL ENGINES

[75] Inventor: Yoji Kato, Okazaki, Japan

[73] Assignee: Nippon Soken, Inc., Nishio, Japan

[21] Appl. No.: 195,504

[22] Filed: Oct. 9, 1980

[30] Foreign Application Priority Data

Oct. 11, 1979 [JP] Japan ..... 54-131656
Dec. 28, 1979 [JP] Japan ..... 54-172455
Dec. 28, 1979 [JP] Japan ..... 54-172456

[51] Int. Cl.[3] ..... F02B 9/08; F02M 17/00
[52] U.S. Cl. ..... 123/145 A; 123/179 BG
[58] Field of Search ..... 123/195 A, 179 H, 179 BG; 219/499

[56] References Cited

U.S. PATENT DOCUMENTS 4,280,452 7/1981 Kawamura ..... 123/145 A

FOREIGN PATENT DOCUMENTS 2906731 6/1979 Fed. Rep. of Germany ... 123/145 A
52-48262 11/1977 Japan ..... 123/145 A

*Primary Examiner*—Ronald B. Cox
*Attorney, Agent, or Firm*—Cushman, Darby & Cushman

[57] ABSTRACT

A parallel circuit of an ordinary resistor exhibiting an ordinary resistance characteristic and a starting resistor abruptly increasing its resistance at a certain temperature is inserted between glow plugs in a Diesel engine and a battery. The resistance of the starting resistor is smaller than that of the ordinary resistor at a normal temperature. The resistance of the starting resistor becomes larger than that of the ordinary resistor when a large amount of current flows through the starting resistor. Therefore, current flows from the battery to the glow plugs mainly through the starting resistor at first, and then it flows mainly through the ordinary resistor. A voltage drop of the battery due to engine starting is prevented by bypassing the parallel circuit by a resistor. Preferably, the starting resistor is of honeycomb shape.

4 Claims, 13 Drawing Figures

PREHEATING APPARATUS FOR DIESEL ENGINES

BACKGROUND OF THE INVENTION

The present invention relates to a preheating apparatus for Diesel engines, which is designed to ensure a rapid glow plug temperature rise characteristic.

In the past, certain types of Diesel engines, known as pre-combustion chamber engines, have been mostly equipped with glow plugs such that during the engine starting the glow plugs are heated red hot and the fuel is burned by contacting it with the glow plugs to thereby facilitate the starting of the engine, and there has been a desire that the time required for heating the glow plugs red hot be reduced as far as possible. In particular, passenger cars equipped with Diesel engines have recently been used for a variety of purposes due to the improved fuel economy of the Diesel engines. However, the vehicles equipped with Diesel engines have been found inferior in starting performance to those equipped with gasoline engines, thus making the necessity of preheating the Diesel engine particularly important in the case of passenger cars.

On the other hand, in order to start the Diesel engine smoothly, it has been necessary to preheat the glow plugs to a temperature of 700° to 1000°C., and in the past the time required for attaining such temperature (hereinafter referred to as a "preheating time") has been considerably long.

In view of these background circumstances, systems have been proposed in which as shown, for example, in Japanese Utility Model Publication No. 48262/77, a resistance unit having a very high positive temperature coefficient of resistance, such as, a resistance unit made from molybdenum disilicide is connected in series with a parallel circuit of glow plugs so that during the starting period a large current is supplied to the glow plugs through the action of the resistance unit and the temperature of the glow plugs is rapidly increased.

However, the prior art apparatus of this type has the following disadvantages.

(1) The resistance value of the resistance unit linearly increases with temperature so that the ratio of change in resistance between the lower and higher temperature ranges is about 6 times and consequently the resistance value at the normal temperature becomes 1/6 of the resistance value in the higher temperature range. Thus, the normal temperature resistance value cannot be set so small that the amount of starting current supplied to the glow plugs is limited considerably depending on the resistance unit and the resulting preheating time is 15 seconds as compared with the conventional time of 20 seconds showing only an improvement by 25%.

(2) When current is being supplied to the glow plugs, the current always flows to the molybdenum disilicide resistance unit so that the resistance unit always generates heat and it is always kept at elevated temperatures with the resulting large change of its characteristics with time. As a result, no matter how accurately the initial resistance value is set, the resistance value is subject to variation with the accumulated period of service time of the glow plugs, thus giving rise to such troubles as burnout failure, faulty heat generation, etc., of the glow plugs.

SUMMARY OF THE INVENTION

With a view to overcoming the foregoing deficiencies in the prior art, it is the object of the present invention to provide an improved preheating apparatus for Diesel engines, which is capable of remarkably reducing the preheating time of glow plugs than previously and also preventing burnout failure of the glow plugs.

To accomplish the above object, the preheating apparatus provided in accordance with the present invention preferably includes a starting resistor unit made from a barium titanate ceramic material having a positive temperature coefficient and whose resistance value abruptly increases at a specified temperature, the resistor unit being connected in the energization circuit of glow plugs, an ordinary resistor unit connected in parallel with the starting resistor unit and having a resistance value which is greater than that of the starting resistor unit when the temperature of the glow plugs themselves is relatively low and which is smaller than that of the starting resistor unit when the glow plug temperature is relatively high, and a bypass energization circuit for applying the power from a battery to the glow plugs without passing the ordinary resistor unit and the starting resistor unit during the cranking period of the engine.

To accomplish the above object, preferably the starting resistor unit used in the apparatus of the present invention has a honeycomb structure in which a plurality of passages are isolated from each other by a plurality of isolating walls and an electrode film is formed on each of the surfaces of the isolating walls so as to cause the flow of current through the isolating walls at right angles thereto.

DESCRIPTION OF THE PREFERRED EMBODIMENTS

In accordance with the present invention a starting resistor unit is mainly composed of barium titanate ($BaTiO_3$) and it is produced by adding to this main component such impurities as manganese (Mn), strontium (Sr), cerium (Ce), etc., forming the material into a honeycomb shape (according to the first embodiment of the invention), baking the honeycomb structure, and then applying and baking an electrode film on each of the inner surfaces of a plurality of isolation walls forming the honeycomb structure.

Figure 7:
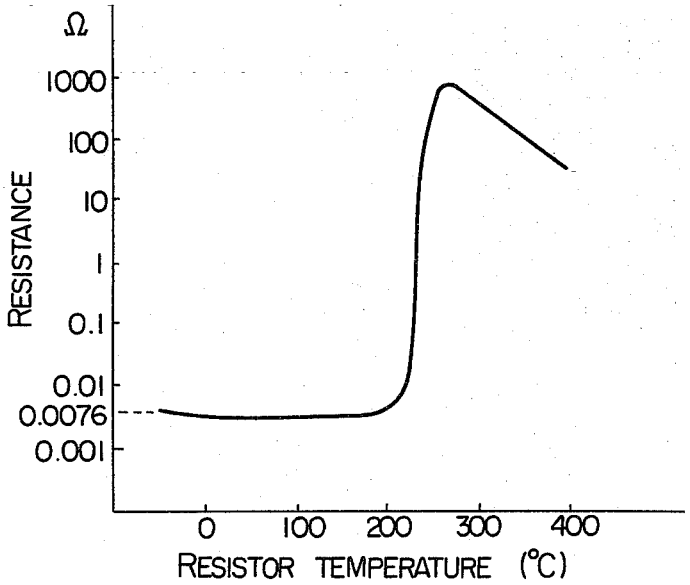
FIG. 7 is a characteristic diagram of the resistor unit 7 of FIG. 1.

This barium titanate type starting resistor unit has a positive temperature coefficient of resistance such as shown in FIG. 7, and it has a resistance value which becomes 0.0076 ohms at the normal temperature (25° C.) and which at a temperature of about 210° C. abruptly increases to 700 ohms. This ratio of change of resistance value is about 100,000 times. While the temperature at which the resistance value increases abruptly (hereinafter referred to as a Curie point) and the ratio of change of resistance are adjustable in dependence on the amounts of impurities added to barium titanate, generally the Curie point and the ratio of resistance change of this type of resistor units are mostly on the order of 100° to 300° C. and 100,000 times, respectively.

In accordance with the present invention, the ordinary resistor unit is composed for example of an ordinary metal resistance wire such as a tungsten wire or nichrome wire. This resistor unit is used in the form of a bare wire or it is incorporated in a ceramic body.

In accordance with the present invention, the following relationship exists between the resistance values of the ordinary and starting resistor units. In other words, when the temperature of the glow plugs themselves is the lower range, the starting resistor unit has a resistance value which is smaller than that of the ordinary resistor unit, whereas when the glow plug temperature is the higher range, the starting resistor unit has a resistance value which is greater than that of the ordinary resistor unit. To cite a specific example, if it is selected so that the resistance value of the starting resistor unit becomes 1/10 of that of the ordinary resistor unit when the glow plug temperature is in the lower range and the resistance value of the starting resistor unit becomes over 10 times that of the ordinary resistor unit when the glow plug temperature is in the higher range, it is possible to ensure a satisfactory rapid glow plug heating effect and it is also possible to provide the glow plugs with the necessary current for normal operation through the ordinary resistor unit when the normal condition is established or when the glow plugs are heated to a temperature high enough for preheating purposes. Consequently, the resistance ratio between the two resistor units must be at least 100 times.

With the present invention, "the higher temperature range of the glow plugs themselves" represents in fact the surface temperatures of the glow plug heat coil which are higher than 800° C. and "the lower temperature range" represents the surface temperatures lower than 800° C. Of course, the necessary glow plug temperature for preheating purposes ranges from 700° to 1000° C. depending on the types of engines as mentioned previously and thus the temperatures represented by the higher and lower temperature ranges vary correspondingly. Thus, if they are defined for purposes of discussion, the higher temperature range represents the temperatures higher than that required for engine preheating purposes and the lower temperature range represents the temperatures lower than the required engine preheating temperature.

In this connection, since the preheating time required for increasing the glow plug temperature to a value necessary for engine preheating purposes coincides with the time required for the starting resistor unit to attain the Curie point, considering from the standpoint of the starting resistor unit the lower temperature range represents the temperatures lower than the Curie point and the higher temperature range represents those higher than the Curie point.

The present invention is also applicable to single-cylinder Diesel engines. Of course, where the present invention is applied to a multi-cylinder Diesel engine, a starting resistor unit may be provided for each of the glow plugs in the respective cylinders.

The present invention will now be described in greater detail with reference to the illustrated embodiments.

Figure 1:
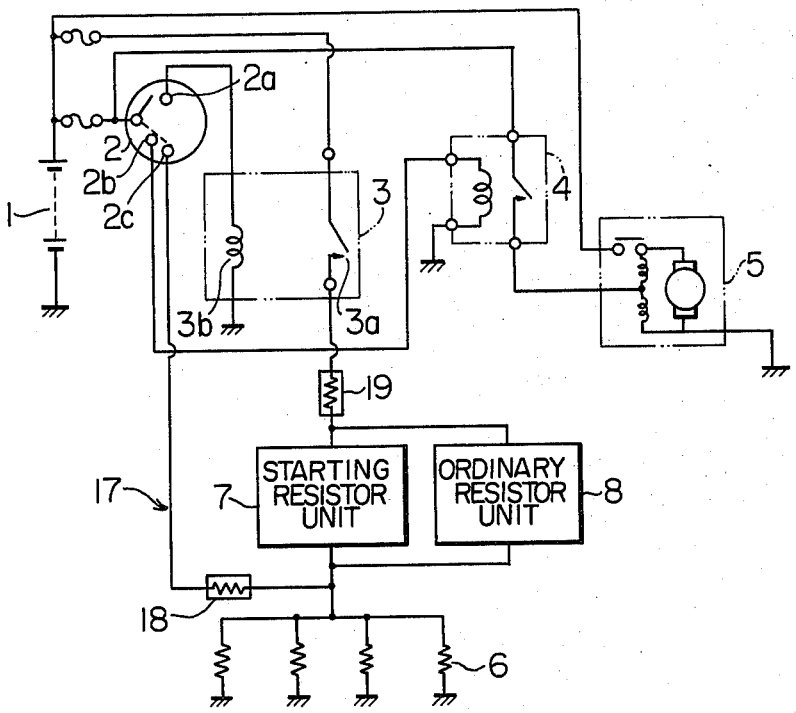
FIG. 1 is a wiring diagram showing a first embodiment of a preheating apparatus according to the present invention.
Figure 2:
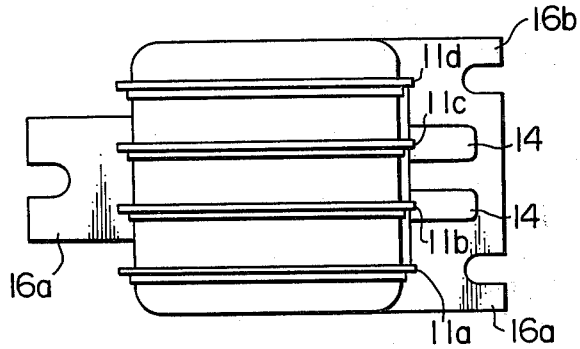
FIGS. 2 to 6 show the construction of the resistor unit 7 of FIG. 1, with FIG. 2 showing its plan view, FIG. 3 its front sectional view, FIG. 4 its half-sectional side view, FIG. 5 its sectional view showing in detail the electrode films 13, and FIG. 6 a perspective view of the resistor unit 7.
Figure 3:
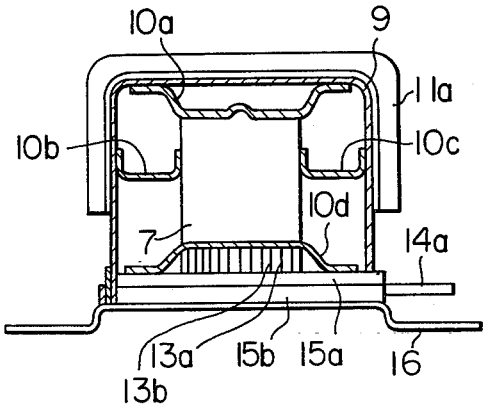
Figure 4:
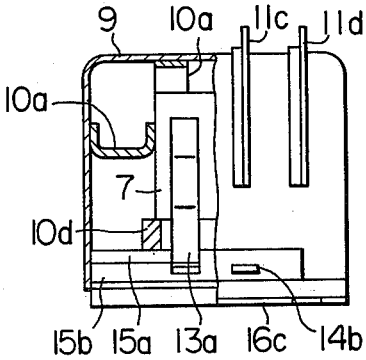
Figure 5:
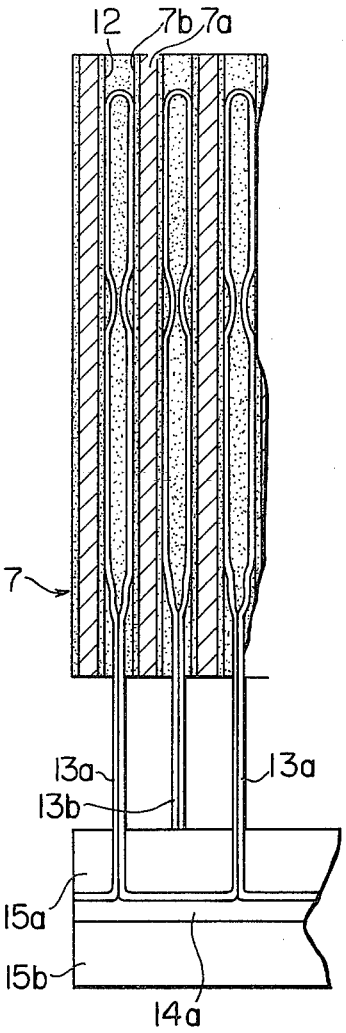

Referring to FIG. 1, numeral 1 designates a vehicle-mounted power source or battery, 2 a starter switch, 2*a* a preheating contact, 2*b* a starting contact, and 2*c* and auxiliary contact. Numeral 3 designates a glow plug relay, 3*a* a normally open contact, and 3*b* a coil. Numeral 4 designates a starter relay, and 5 a starter. Numeral 6 designates glow plugs of the known sheathed structure (not shown in detail) in which a heat coil is contained within a heat resisting metal tube through the intermediary of electrical insulating powder. The forward end of each of the metal tubes is reduced in diameter so as to reduce the heat capacity. The glow plugs 6 are each disposed in one of the pre-combustion chambers of cylinder-head of a Diesel engine, and a plurality, e.g., four, of the glow plugs 6 are connected in parallel. Numeral 7 designates a starting resistor unit composed of the previously mentioned barium titanate type ceramic and it has a characteristic as shown in FIG. 7. Its Curie point is about 210° C. and it has a resistance value of about 0.0076 ohms until reaching the Curie point at which the resistance value abruptly increases to 700 ohms. The single resistor unit 7 is connected in series with the parallel circuit of the glow plugs 6. Numeral 8 designates an ordinary resistor unit of the previously mentioned type having a resistance value of 0.068 ohms, and it is composed for example of a small diameter (1 to 2 mm) nichrome wire wound 2 to 5 times in loop shape and having a structure which is likely to be exposed to and cooled by the air (i.e., the same structure as a preheating indicating glow plug controller 19 disposed within the vehicle compartment). The ordinary resistor unit 8 is contained in a case and mounted inside the engine room.

Figure 6:
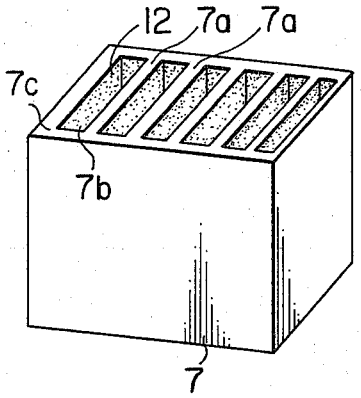

Next, the construction of the starting resistor unit 7 will be described in detail with reference to FIGS. 2 to 6. In the Figures, the starting resistor unit 7 is contained and held in place by means of metal plate springs 10*a*, 10*b*, 10*c* and 10*d* in a case 9 made from a material having good heat conductive and heat resisting properties, such as aluminum. Formed on the outer surface of the case 9 are fins 11*a*, 11*b*, 11*c* and 11*d*. As shown in FIG. 6, the resistor unit 7 is shaped to form a honeycomb structure in which a plurality of isolation walls 7*a* and a frame member 7*c* are arranged to define a plurality of passages 7*b*. This structure is produced by for example assemblying barium titanate ceramic green sheets and then baking the assembly. An electrode 12 in thin film form is formed all over each of the surfaces of the isolation walls 7*a* of the resistor unit 7 which face the passages 7*b*. The electrodes 12 are each composed for example of a baked silver paste. The electrodes 12 on the respective isolation walls 7*b* are electrically isolated from each other by the isolation walls 7*b*, since no electrode 12 is formed on the end faces of the isolation walls 7*a*. Inserted within each of the passages 7*b* of the resistor unit 7 is a positive electrode plate 13*a* or negative electrode plate 13*b* having its forward end portion formed into a loop shape and contacted electrically with the electrodes 12 on the isolation walls 7*a*. These positive and negative electrode plates 13*a* and 13*b* are disposed alternately in the passages 7*b* of the resistor unit 7. As a result, each of the positive and negative electrode plates 13*a* and 13*b* is assembled as a separate unit. Also, the positive and negative electrode plates 13*a* and 13*b* are respectively connected electrically to positive and negative terminal strips 14*a* and 14*b*. Thus, if conduction is established between the alternate positive and negative electrode plates 13*a* and 13*b*, current flows through the isolation walls 7*a* in a direction perpendicular to the axes of the passages 7*b*. The terminal strips 14*a* and 14*b* and the electrode plates 13*a* and 13*b* are held between insulating plates 15*a* and 15*b* having heat resisting and electrical insulating properties and the insulating plates 15*a* and 15*b* are secured to a metal mounting base 16. Each of the terminal strips 14*a* and 14*b* has its one end projected to the outside of the case 9 and these ends are electrically connected to the terminals of the battery 1. The metal mounting base 16 is formed with integral mounting stays 16*a*, 16*b* and 16*c* and the mounting base 16 is mounted inside the engine room by means of screws and the mounting stays 16*a*, 16*b*, 16*c* and 16*d*. The case 9 is secured to the mounting base 16 by screws.

With the construction described above, the operation of the apparatus is as follows. When the switch 2 is operated so that the preheating contact 2*a* is closed, the current flows from the battery 1 to the coil 3*b* of the glow plug relay 3 so that an attractive force is produced in the coil 3*b* and the normally open contact 3*a* is closed. At this time, since the engine must be preheated and hence the temperature of the glow plugs 6 is low as a matter of course, as shown in FIG. 7 the resistance value of the starting resistor unit 7 is 0.0076 ohms and this is considerably smaller than that of the ordinary resistor unit 8 which is 0.068 ohms. As a result, the current from the battery 1 flows to the glow plugs 6 through the normally open contact 3*a* and mainly through the starting resistor unit 7, causing the glow plugs 6 to generate heat. In this case, due to the fact that just after the beginning of the current flow the resistor unit 7 is not generating heat and that the electrodes 12 have a large area and a very small resistance value due to the honeycomb structure, a large current flows to the glow plugs 6. While the resistor unit 7 generates heat as the conduction time passes, as will be seen from the characteristic diagram of FIG. 7, the resistance value of the resistor unit 7 remains practically unchanged until its self-heated temperature reaches the Curie point of 210° C. and the large current continuously flows to the glow plugs 6. As a result, the energized temperature rise time of the glow plugs 6 becomes faster considerably. While the large current flowing continuously to the glow plugs 6 tends to cause their heat coils to burn out, the resistor unit 7 generates heat as the conduction time passes and its temperature eventually attains the Curie point of FIG. 7. As a result, the resistance value of the resistor unit 7 increases abruptly and the current flowing in the resistor unit 7 rapidly decreases, thus preventing the heat coils of the glow plugs 6 from being burnt out.

When the resistance value of the resistor unit 7 abruptly increases (up to 700 ohms), the resistance value (0.068 ohms) of the ordinary resistor unit 8 connected in parallel with the resistor unit 7 now becomes smaller than that of the latter and consequently the current from the battery 1 is supplied to the glow plugs 6 mainly through the ordinary resistor unit 8. As a result, the temperature of the glow plugs 6 is maintained at the required value for the normal operation of the engine.

Due to its honeycomb structure, the resistor unit 7 has a very large heat transfer surface area. Also, the heat dissipation of the resistor unit 7 is improved by placing it in the case 9 having the fins 11*a*, 11*b*, 11*c* and 11*d*. Thus, the supply of current to the glow plugs 6 through the resistor unit 7 is adjusted in accordance with the time constant which is determined by the amount of heat generated and the amount of heat dissipated by the resistor unit 7.

Then, as the switch 2 is operated so that the starting contact 2*b* is closed and the starter 5 is energized, the starter 5 consumes a large amount of current and thus the terminal voltage of the battery 1 drops from about 12 volts to about 5 volts. In accordance with the present embodiment, however, the auxiliary contact 2*c* is closed simultaneously with the closing of the starting contact 2*b*, so that the current is directly supplied from the battery 1 to the glow plugs 6 through a bypass energization circuit 17 and thus the heated temperature of the glow plugs 6 is not decreased even if the terminal voltage of the battery 1 drops while the starter 5 is in operation. In this case, if the rated voltage of the glow plugs 6 is about 6.5 volts and the terminal voltage of the battery 1 is 7 volts, there is the danger of the glow plugs 6 being burnt out. However, this difficulty is overcome by the provision of a resistor unit 18 of a small value (e.g., 0.028 ohms) in the bypass energization circuit 17 so as to decrease the terminal voltage of 7 volts to about 6.5 volts.

Figure 8:
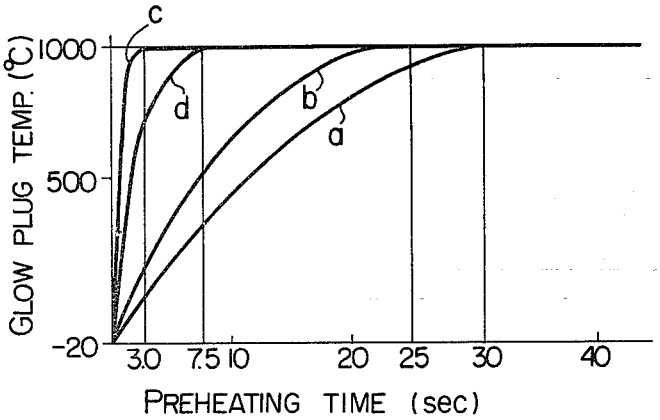
FIG. 8 is a characteristic diagram useful in explaining the effects of the apparatus of this invention.

In this connection, the results of the experiments conducted by the inventor showed that a comparison between the prior art apparatus and the present embodiment of the invention in terms of the time required for increasing the plug temperature from −20° C. up to 1000° C. resulted as shown in FIG. 8. In the prior art apparatus in which the glow plugs were connected directly to the battery by way of the switch, the rated voltage of the glow plugs was 11 volts (9 A) as compared with 6 volts (18 A) in the present embodiment. In the prior art apparatus the resistance value of the glow plugs 6 themselves was 1.2 ohms and that of the present embodiment was 0.33 ohms. The resistance value of the known molybdenum disilicide resistor unit was the same as disclosed in Japanese Utility Model Publication No. 48262/77. In FIG. 8, the line a shows the result of the prior art apparatus, the line b the result obtained with the known molybdenum disilicide and the line c the result of the present embodiment of the invention. As will be apparent from FIG. 8, the line c representing the embodiment of this invention shows that the rise time required for the glow plug temperature to rise from −20° C. to 1000° C. is about 3.0 seconds and this is remarkably fast as compared with 30 seconds of the line a and 25 seconds of the line b. Further, in accordance with the present embodiment the required energized temperature for operating the engine can be maintained through the action of the ordinary resistor unit 8 in the same manner as in the case of the prior art apparatus.

With the thusly constructed starting resistor unit 7 of this embodiment, by virtue of the provision of the electrodes on the surfaces of the isolation walls, the total electrode area is proportional to the number of the isolation walls, with the result that the electrode area can be increased easily by increasing the number of isolation walls and that the gap between the electrodes through which the current flows through the isolation walls at right angles thereto can be reduced by reducing the thickness of the isolation walls. In this case, due to the entire unit being of the honeycomb structure, even if the thickness of the isolation walls is reduced, there is no danger of deteriorating the strength.

As a result, the resistance value of the starting resistor unit 7 decreases considerably in accordance with the following equation $$\Omega = \rho \times l = S$$

where $\Omega$ is the resistance, $\rho$ is the specific resistance, l is the electrode gap, S is the electrode area.

Thus, the honeycomb barium titanate starting resistor unit provided in accordance with this invention has a very small resistance value at the normal temperature as compared with that of the prior art molybdenum disilicide resistor unit and it is also very small in size as compared with the known barium titanate resistor units having shapes other than the honeycomb structure, thus ensuring the supply of a large current (e.g., about 80 A) to the glow plugs and remarkably reducing the preheating time of the glow plugs.

Further, since the starting resistor unit of this invention has a honeycomb structure with a large surface area, even if it reaches the Curie point temperature through the generation of heat by itself, it has an excellent heat dissipating property so that when the engine fails to start and the current is supplied again to the glow plugs to start the engine again, the reenergization time of the glow plugs can be reduced considerably.

The embodiments of the present invention are not intended to be limited to the starting resistor unit 7 of the honeycomb structure shown in FIG. 6 and the honeycomb structure of any of many other shapes may of course be used. Also, the electrodes 12 may be formed by a plating method.

Figure 9:
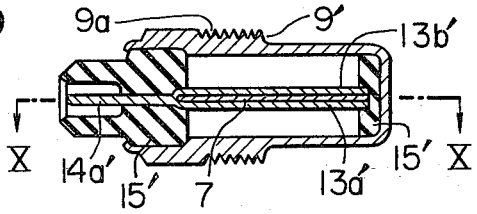
FIG. 9 is a sectional view showing another form of the resistor unit 7 of FIG. 1.
Figure 10:
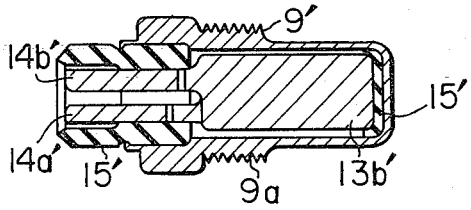
FIG. 10 is a sectional view looked in the direction of the arrow line X—X of FIG. 9.
Figure 11:
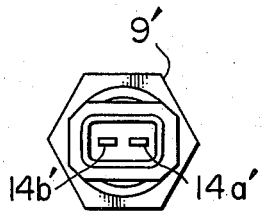
FIG. 11 is a left side view of FIG. 9.

The starting resistor unit 7 can be formed into a plate shape. FIGS. 9 to 11 show a specific structure of the plate type. In the Figures, the starting resistor unit 7 has a rectangular plate shape and it is placed in a metallic case 9' made from brass or the like having a good heat conducting property. An electrode film is formed on each side of the resistor unit 7 by applying and baking silver paste. The metallic case 9' includes a threaded portion 9*a* for securing the case 9' to the cylinder head or the cylinder block of the engine. In the case of this embodiment, the case 9' is screwed into the cylinder head. Electrodes 13*a*' and 13*b*' in thin sheet form are mounted on the sides of the resistor unit 7. The resistor unit 7 placed between the electrodes 13*a*' and 13*b*' is supported inside the case 9' by support members 15' made from a heat resisting and electrical insulating material. In the Figures, numerals 14*a*' and 14*b*' designate terminals of the electrodes 13*a*' and 13*b*'.

When used with the first embodiment shown in FIG. 1, the resistor unit 7 of the structure shown in FIGS. 9 to 11 operates in the same manner as mentioned previously and the temperature rise time required for the temperature of the glow plugs 6 to rise from −20° C. to 1000° C. is about 7.5 seconds as shown by the line d in FIG. 8. This rise time is somewhat slower than that of the resistor unit 7 of the honeycomb structure shown in FIGS. 2 to 6 but is still faster than those of the lines a and b representing the prior art techniques as will be seen from FIG. 8.

Figure 12:
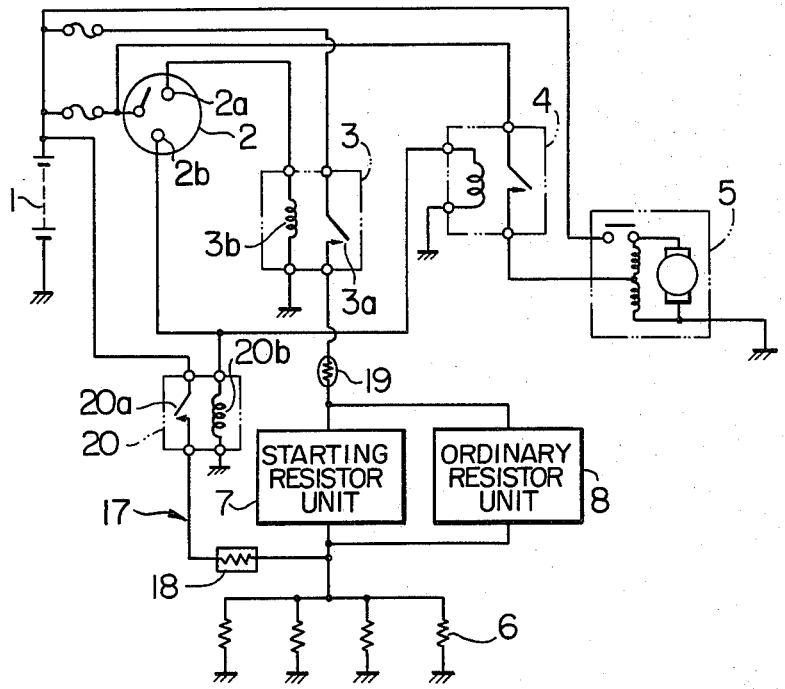
FIG. 12 is a wiring diagram showing a second embodiment of the apparatus according to the invention.

Referring now to FIG. 12, there is illustrated a second embodiment which differs from the first embodiment of FIG. 1 in that the auxiliary contact 2*c* of the starter switch 2 is replaced with a relay 20, so that when the engine is cranked, a coil 20*b* of the relay 20 is energized through the starting contact 2*b* and a contact 20*a* is closed, thus directly applying the battery voltage to the glow plugs 6 through the bypass energization circuit 17 upon closing of the contact 20*a*.

Figure 13:
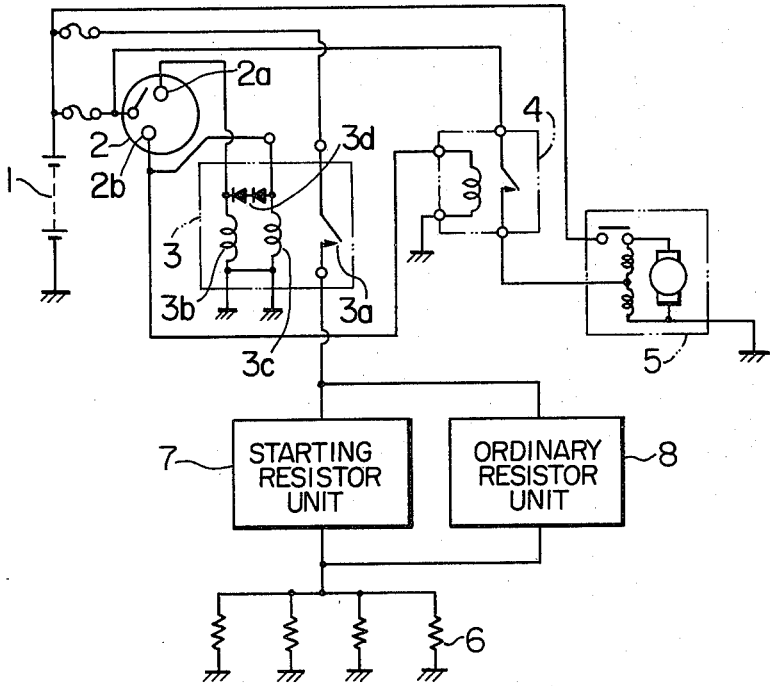
FIG. 13 is a wiring diagram showing a third embodiment of the apparatus according to the invention.

Referring to FIG. 13, there is illustrated a third embodiment of the invention which differs from the first embodiment of FIG. 1 in that the auxiliary contact 2*c* of the starter switch 2 and the bypass energization circuit 17 (including the resistor 18) are eliminated and that the starting contact 2*b* of the starter switch 2 is connected to a coil 3*c* of the glow plug relay 3 and the coils 3*b* and 3*c* are connected to each other through diodes 3*d*. In this third embodiment the resistance value of the ordinary resistor unit 8 is selected 0.3056 ohms.

In FIG. 13, when the switch 2 is closed to the preheating contact 2*a*, the current flows from the battery 1 to the coil 3*b* of the glow plug relay 3 and the normally open contact 3*a* is closed. In this case, the flow of the current from the battery 1 to the starter relay 4 is prevented by the diodes 3*d*. The remaining operation is the same with that which took place when the switch 2 was closed to the preheating contact 2*a* in FIG. 1.

Then, as the switch 2 is closed to the starting contact 2*b*, the starter 5 is energized.

The remaining operation of this embodiment is the same as mentioned previously. Thus, if, for example, the starting resistor unit 7 of the plate shape shown in FIGS. 9 to 11 is used, the temperature rise time required for the temperature of the glow plugs 6 to rise from −20° C. to 1000° C. becomes about 7.5 seconds as shown by the line d in FIG. 8.

We claim:

1. A preheating apparatus for Diesel engines comprising:

a glow plug disposed in a cylinder-head of an engine;

starting resistor means connected between a voltage source and said glow plug, said starting resistor means including a resistance body principally composed of barium titanate to exhibit a resistance characteristic of a positive resistance temperature coefficient and abruptly increasing its resistance value at a predetermined temperature; and ordinary resistor means connected in parallel with said starting resistor means;

said starting resistor means showing a resistance value smaller than that of said ordinary resistor means when a temperature of said glow plug is relatively low, and said starting resistor means showing a resistance value larger than that of said ordinary resistor means when the temperature of said glow plug is relatively high.

2. An apparatus according to claim 1, wherein said resistance material is substantially of honeycomb shape having a plurality of passages isolated from each other by a plurality of isolating walls each having an electrode film on its surface, and wherein said starting resistor means further includes:

positive contact electrode means and negative contact electrode means for contacting with said electrode films so that each of said isolating walls is inserted between each of said positive and negative contact electrode means pairs, to thereby flow current through said walls in a direction perpendicular to the axes of said passages; and a metallic case for covering said resistance material.

3. An apparatus according to claim 1, wherein said resistance material is of substantial plate shape, and wherein said starting resistor means further includes:

positive and negative electrode means for sandwiching said resistance material; and a metallic case for covering said resistance material.

4. An apparatus according to claim 1, 2 or 3, further comprising:

switch means having a preheating contact position for supplying current from said voltage source to said glow plug through the parallel circuit of said starting resistor means and said ordinary resistor means, and a starting contact position; and bypass means connected between the starting contact position and said glow plug, and including a resistor for adjusting a voltage across said glow plug, said bypass means supplying current from said voltage source to said glow plug through said voltage adjusting resistor during starting of said engine.

* * * * *